United States Patent [19]

MacNitt, Jr. et al.

[11] 4,252,011

[45] Feb. 24, 1981

[54] DIE ASSEMBLY FOR USE IN FORGING OPERATION

[75] Inventors: Donald G. MacNitt, Jr., Singer Island; Bryant H. Walker, Stuart, both of Fla.

[73] Assignee: United Technologies Corporation, Hartford, Conn.

[21] Appl. No.: 90,211

[22] Filed: Nov. 1, 1979

[51] Int. Cl.[3] ..... B21K 1/32

[52] U.S. Cl. ..... 72/354; 72/358; 72/401; 72/474; 29/159 R

[58] Field of Search ..... 72/353, 465, 354, 474, 72/357, 401, 358, 359, 360; 29/159 R, 159.1, 159.2, 159.01

[56] References Cited

U.S. PATENT DOCUMENTS

| | | | |
|---|---|---|---|
| 2,125,068 | 7/1938 | Dempsey | 72/358 |
| 2,689,068 | 9/1954 | Lyon | 72/481 X |
| 3,519,503 | 7/1970 | Moore et al. | 148/11.5 F |
| 4,051,708 | 10/1977 | Beane et al. | 72/354 |
| 4,063,939 | 12/1977 | Weaver | 29/156.8 R |
| 4,074,559 | 2/1978 | Beane | 29/159 R |
| 4,150,557 | 4/1979 | Walker | 29/156.8 B |

*Primary Examiner*—Leon Gilden

*Attorney, Agent, or Firm*—Robert C. Walker

[57] ABSTRACT

The present invention provides a technique for improving the dimensional accuracy of forged components. Uniformity of like component details is sought and a specific object is to provide a die package for forming closely toleranced appendages integrally with a central disk structure from which the appendages extend.

In one effective embodiment incorporating concepts of the present invention, the forging dies include a stationary die 26 and a moveable die 28 which are mounted on a common axis and a plurality of arcuate die segments 30 which are adjacently placed in cylindrical array about the stationary and moveable dies. The arcuate die segments form cavities of the inverse geometry of the appendages to be formed and are interlocked to prevent tilting of the segments in the die package. A collar 40 extends from the stationary die to interlocking engagement with a channel 46 in the inwardly facing surface of each arcuate die segment.

5 Claims, 4 Drawing Figures

DIE ASSEMBLY FOR USE IN FORGING OPERATION

TECHNICAL FIELD

This invention relates to forging apparatus and particularly to die assemblies in which a billet of stock material is deformed at elevated temperatures to a desired shape.

The concepts were developed in the gas turbine engine field for the production of integrally bladed rotors, but have wide applicability in any industry in which similarly configured parts of accurate dimension are desired.

BACKGROUND ART

U.S. Pat. No. 3,519,503 to Moore et al entitled "Fabrication Method for the High Temperature Alloys", of common assignee herewith, describes a forging process developed by Pratt & Whitney Aircraft, Division of United Technologies Corporation, Hartford, Connecticut and known internationally as the GATORIZING® forging process. By the disclosed process, high strength, difficult to forge alloys such as those used in the gas turbine engine industry, are deformable from a billet of stock material to a nearly finished shape of relatively complex geometry. Although, only disk-shaped components were initially forged, the attractiveness of forming integrally bladed rotor disks spurred subsequent developments.

An initial die package and process for forming such integrally bladed rotors is disclosed and illustrated in U.S. Pat. No. 4,051,708 to Beane et al entitled "Forging Method" and in the divisional case thereof U.S. Pat. No. 4,074,559 to Beane et al also entitled "Forging Method". Both patents are of common assignee herewith. In accordance with these concepts, integral appendages are forged between a plurality of adjacent dies positioned about the circumference of the disk forming dies. Yet further advances include the techniques for separating the appendage forming dies from the finished forging. Two such techniques are illustrated in U.S. Pat. No. 4,041,161 to Kelch entitled "Apparatus and Method for Removing a Plurality of Blade Dies" and 4,150,557 to Walker et al entitled "Forging Apparatus Having Means for Radially Moving Blade Die Segments".

Notwithstanding the above stated advances in the forging field, scientists and engineers continue to search for new concepts and techniques which enhance the manufacturability of forged components and improve the quality of such components.

DISCLOSURE OF INVENTION

According to the present invention a die package for forming a central disk structure and a plurality of circumferentially spaced appendages extending therefrom includes a cylindrical array of appendage forming dies which are rigidly interlocked to prevent relative tilting of the appendage forming dies.

According to one form of the invention the die package includes a stationary die and a moveable die which are circumscribed by the array of appendage forming dies and includes means for interlocking the die segments with the stationary die to prevent relative tilting of the appendage forming dies.

In another form of the invention a pair of opposing end dies are circumscribed by the array of appendage forming dies and a free standing ring is disposed in interlocking relationship with the appendage forming dies to prevent relative tilting of the appendage forming dies.

A primary feature of the invention is interlocking engagement such as that illustrated between the stationary die and the circumscribing arcuate die segments. In one embodiment the stationary die has a collar which extends circumferentially thereabout. The collar is tapered to enable radial disassembly of the arcuate die segments from the formed appendages. A conical surface at the bottom of the collar is aligned with the axis of the appendages and with the direction of withdrawal of the segments from the appendages. Another feature is the channel in the lower portion of each arcuate die. Each channel is formed to the inverse geometry of the collar and is closely dimensioned thereto to provide stable interlocking of each die segment with the stationary die. A wire about the outer circumference of the arcuate dies holds the dies of the die package in a unitized assembly. In another embodiment of the invention, channels in the upper portions of the arcuate die segments interlock with a freestanding ring through which the moveable die slides.

A principal advantage of the present invention is an enhanced ability to form components having closely toleranced appendages. Stability of the appendage forming dies in the package is achieved. The stable package is well suited to automated forging techniques in which a preassembled and preheated package containing the billet to be forged is inserted into the forging furnace.

The foregoing, and other features and advantages of the present invention, will become more apparent in the light of the following description and accompanying drawing.

DETAILED DESCRIPTION

Figure 1:
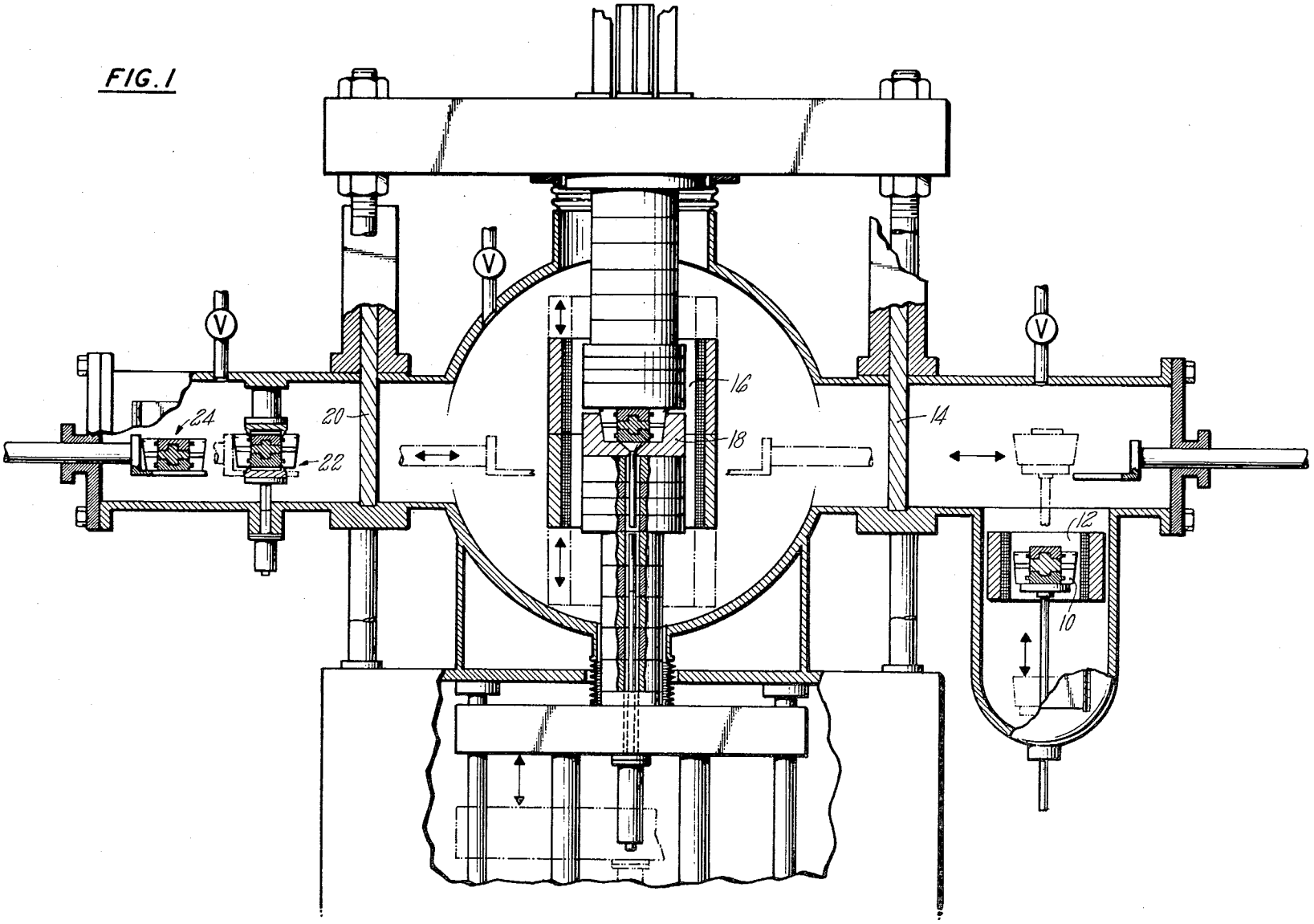
FIG. 1 is a schematic illustration of an automated forging apparatus of the type in which the die package of the present invention is employable.

The apparatus of the present invention is known to have high utility in the forging field, and particularly in the forging of components having complex geometries by the techniques described in U.S. Pat. No. 3,519,503 to Moore et al entitled "Fabrication Method for the High Temperature Alloys". The Moore et al process is well suited to automated manufacture such as that illustrated in the FIG. 1 simplified representation of an automated forging apparatus.

During operation of the automated forging apparatus represented, a die package 10 containing a billet of stock material to be forged is placed in a preheat furnace 12 where the temperature of the die package and of the billet is raised to the approximate temperature at which the forging process is to be executed. The heated package and billet is then shuttled through a door 14 into a forging chamber 16 and is placed in a bull ring 18 and a second die package including billet is loaded into the preheat furnace. The originally preheated billet is deformed within the die package to a desired geometry in the forging furnace under conditions of elevated temperature and pressure such as those disclosed in U.S. Pat. No. 3,519,503 to Moore et al entitled "Fabrication Method for the High Temperature Alloys", of common assignee herewith. The deformed billet and die package are next raised out of the bull ring and shuttled through the door 20 to a die expansion station 22, and thence to a cooldown chamber 24. The second die package is shuttled into the forging chamber and the process is continued until the desired number of parts are formed. Die packages of the present invention are capable of being transported into and out of the respective chambers without introducing intolerable misalignment of the dies.

Figure 2:
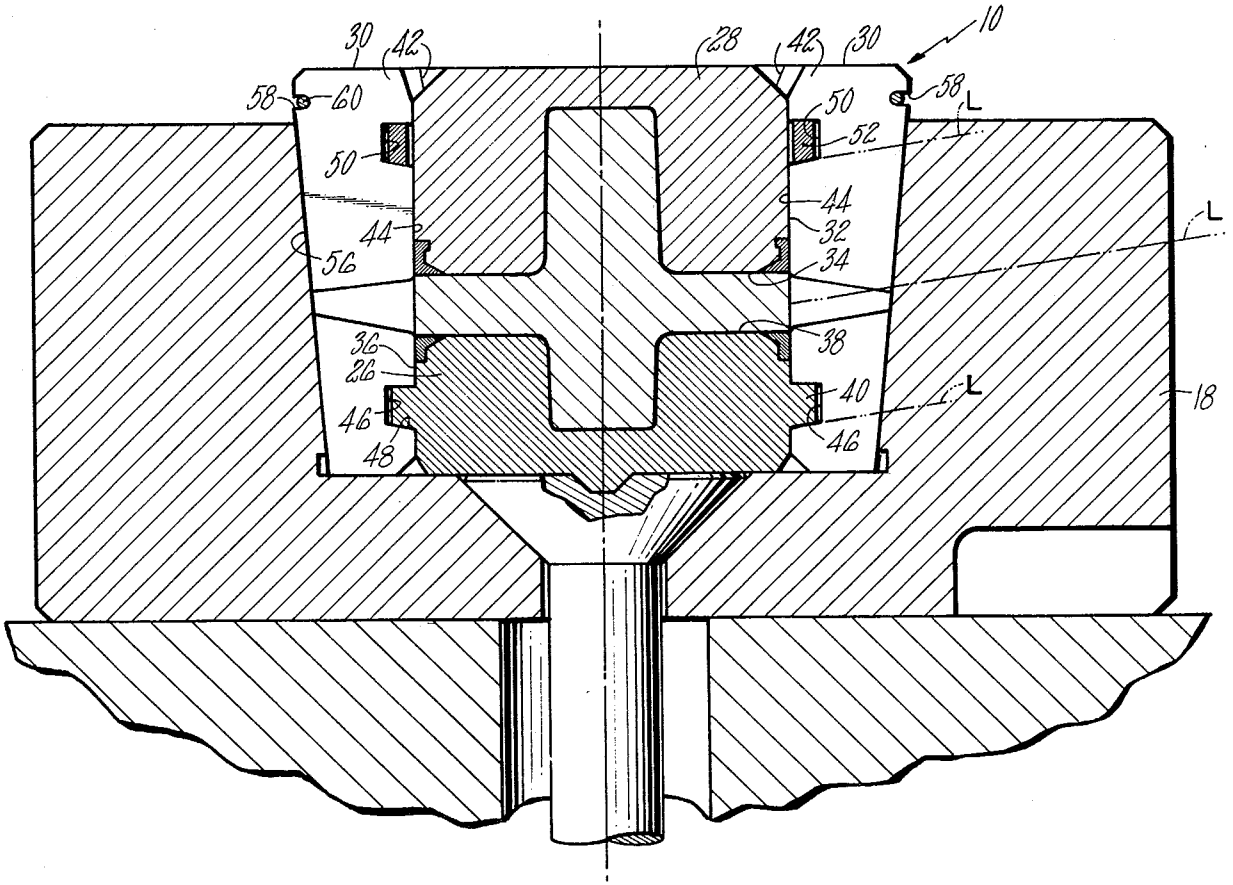
FIG. 2 is a cross section view of the unitized die package of the present invention.

A die package 10 constructed in accordance with the concepts of the present invention is shown in detail in the FIG. 2 partial cross section view as mounted in the bull ring 18. The die package has a pair of end dies mounted on a common axis, the stationary die 26 and the moveable die 28. A plurality of arcuate die segments 30 are adjacently placed in cylindrical array about the stationary and moveable dies, and form in conjunction therewith a cavity having the inverse geometry of the desired component including appendages where appropriate. The moveable die has an outer cylindrical surface 32 and an end surface 34. The end surface of the moveable die is formed to the inverse geometry of one side of the component to be formed. The stationary die has a cylindrical outer surface 36 and an end surface 38. The end surface of the stationary die is formed to the inverse geometry of the other side of said component to be formed. A circumferentially extending collar 40 is raised outwardly from the cylindrical outer surface of the stationary die.

Each of the die segments 30 has a pair of circumferential side walls 42 which are contoured to form, in conjunction with the side walls of the adjacent segments, a plurality of circumferentially spaced cavities having the inverse geometry of the appendages to be formed. Each segment has an inner arcuate surface 44 including a channel 46 extending thereacross which interlocks with the collar 40 of the stationary die to prevent tilting of each segment with respect to the stationary die. The collar has at least one tapered side surface 48 which enables withdrawal of the die segments from the collar along a desired line of pull (L) from the appendages. In a more detailed die package containing further concepts of the invention is also illustrated in FIG. 2, the inner arcuate surface 44 of each segment 30 includes a second channel 50 in the region of the moveable die 28. Each channel 50 interlocks with a ring 52 of closely dimensioned tolerance therewith to provide additional resistance to segment tilting. As is the case with the collar the ring has a tapered side surface 54 which enables withdrawal of the segments 30 from the ring along the desired line of pull (L). The collar and ring concepts may be used independently or in combination.

Each die segment 30 further has an outer arcuate surface 56 having a groove extending thereacross to form in composite with the grooves of the adjacent segments, an outer channel 58 which extends fully around the cylindrical array. A wire 60 extends within the outer channel 58 about the die segments to hold the elements of the die package in a unitized assembly.

Figure 3B:
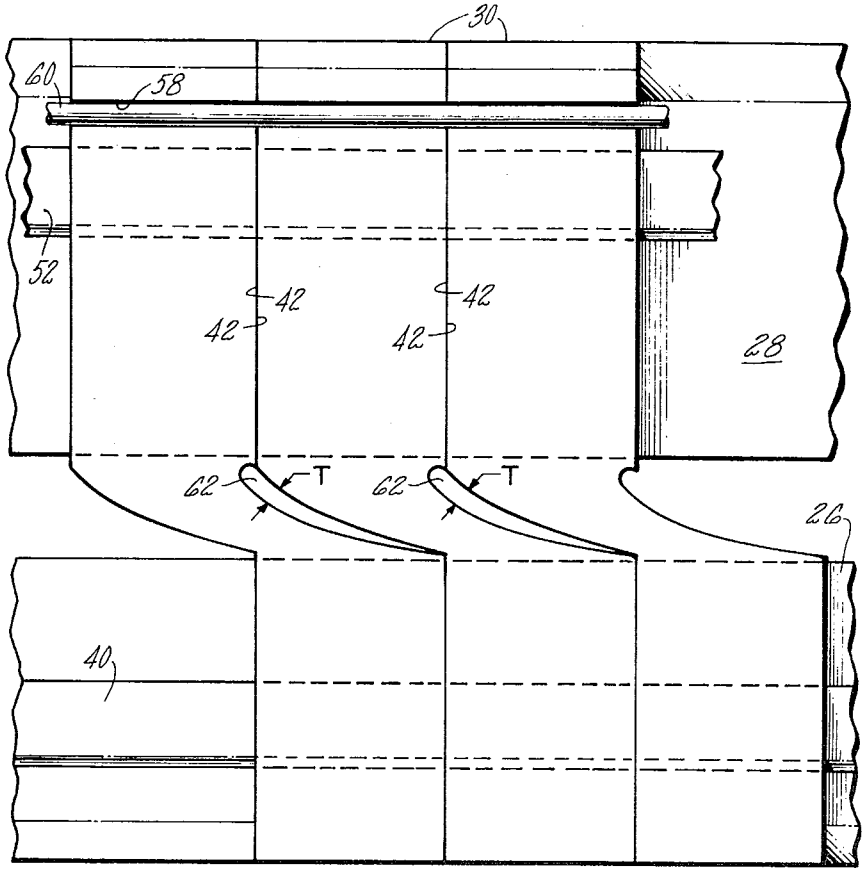
FIG. 3A (Prior Art) and FIG. 3B are a comparative illustration showing the ability of the concepts of the present invention to improve the manufacturing tolerance of appendage parts formed in the die package of the present invention.
Figure 3A:
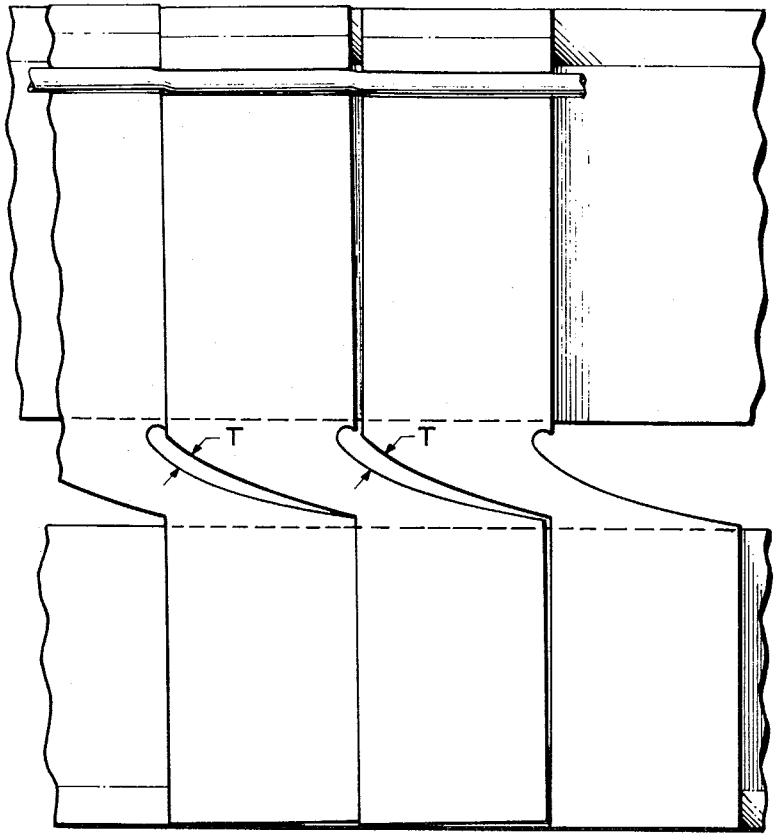
FIG. 3A PRIOR ART

The principle advantage of interlocking the arcuate die segments to a common element, such as the stationary die 26 or the ring 52, is shown in the FIG. 3A and 3B illustrations. The illustrations compare prior art dies (FIG. 3A) with dies of the present invention (FIG. 3B). Arcuate die segments 30 of the type utilized in forming axial flow rotor blades integrally with a rotor disk are shown. Cavities 62 into which billet material is to be forged, are defined by the side walls 42 of the segments.

In the FIG. 3A (Prior Art) illustration a slight axial tilt between segments introduces significant variations in the thickness T of the airfoils. Resultantly, the airfoils of the finished rotor blade component may have unpredictable aerodynamic characteristics and insufficient structural integrity.

In the FIG. 3B illustration of the present invention concepts, the segments 30 are interlocked to the stationary die by the collar 40 and ring 52. Resultantly, the segments are prevented from tilting and the blade thicknesses T remain homogeneous.

Although the invention has been shown and described with respect to detailed embodiments thereof, it should be understood by those skilled in the art that various changes and omissions in form and detail may be made therein without departing from the spirit and the scope of the invention.

We claim:

1. A die package for forming a central disk structure and a plurality of integrally formed appendages extending therefrom, said die package comprising:

a stationary die of generally cylindrical geometry which has a cylindrical outer surface and a top surface formed to the inverse geometry of one side of the central disk structure;

a moveable die of generally cylindrical geometry which has a cylindrical outer surface and an end surface formed to the inverse geometry of the other side of the central disk structure, said moveable die being axially aligned with said stationary die and spaced apart therefrom;

a cylindrical array of circumferentially adjacent die segments, each segment having a pair of circumferential side walls in abutting relationship with the side walls of the adjacent segments and being contoured to form therewith a plurality of circumferentially spaced cavities of the inverse geometry of the appendages to be formed, an inner arcuate surface contacting the outer surfaces of said stationary and moveable dies, a channel extending across the inner arcuate surface; and means engaging the channel of each die segment for interlocking said die segments of the cylindrical array to prevent tilting thereof in the die package.

2. The die package according to claim 1 wherein said means for interlocking the die segments comprises a circumferentially extending collar which is raised outwardly from the cylindrical outer surface of the stationary die and which interlockingly engages the channel of each die segment to prevent tilting of the segments.

3. The die package according to claim 2 wherein the inner arcuate surface of each of said die segments has a second channel thereacross and wherein said means for interlocking the die segment further includes a ring which interlockingly engages the second channel of each die segment.

4. The die package according to claim 1 wherein said means for interlocking the die segments comprises a ring which interlockingly engages the channel of each die segment to prevent tilting of the segments.

5. The die package according to claim 1, 2, 3 or 4 wherein each of said arcuate die segments has an outer arcuate surface having a groove extending thereacross to form an outer channel about the die segments and wherein the die package further has a wire extending circumferentially about the array of segments in the grooves of the outer surfaces to hold the elements of the package in a unitized assembly.

* * * * *